US007977555B2

(12) United States Patent
Hall et al.

(10) Patent No.: US 7,977,555 B2
(45) **Date of Patent: *Jul. 12, 2011**

(54) METHOD OF MODIFYING THE FREQUENCY RESPONSE OF A WOODEN ARTICLE

(75) Inventors: James Hall, Tampa, FL (US); Daniel P. Hess, Lutz, FL (US)

(73) Assignee: University of South Florida, Tampa, FL (US)

( * ) Notice: Subject to any disclaimer, the term of this patent is extended or adjusted under 35 U.S.C. 154(b) by 120 days.

This patent is subject to a terminal disclaimer.

(21) Appl. No.: 12/185,906

(22) Filed: Aug. 5, 2008

(65) Prior Publication Data

US 2008/0289483 A1 Nov. 27, 2008

Related U.S. Application Data

(63) Continuation-in-part of application No. 11/668,031, filed on Jan. 29, 2007.

(60) Provisional application No. 60/763,021, filed on Jan. 27, 2006.

(51) Int. Cl.
*G10D 3/00* (2006.01)

(52) U.S. Cl. ..... 84/291

(58) Field of Classification Search ..... 84/291
See application file for complete search history.

(56) References Cited

U.S. PATENT DOCUMENTS 1,197,116 A 9/1916 Floyd
1,467,576 A * 9/1923 Flydal ..... 84/10
1,836,089 A * 12/1931 Schweitzer ..... 84/452 R
2,911,872 A * 11/1959 Wendel ..... 84/173
3,194,870 A 7/1965 Tondreau et al.
3,656,395 A * 4/1972 Kaman ..... 84/267
3,774,009 A 11/1973 Hodges
3,824,343 A 7/1974 Dahlquist
3,825,666 A 7/1974 Jaggers
3,860,086 A * 1/1975 Mahajan et al. ..... 181/200
4,245,540 A 1/1981 Groupp
4,348,552 A 9/1982 Siccone
4,387,297 A 6/1983 Swartz et al.
4,496,831 A 1/1985 Swartz et al.
4,538,072 A 8/1985 Immler et al.
4,593,186 A 6/1986 Swartz et al.
4,678,715 A * 7/1987 Giebeler et al. ..... 428/537.1
(Continued)

OTHER PUBLICATIONS

"Instant Vintage "by Rick Turner http://web.archive.org/web/20011217060900/http://www.acousticguitar.com/Gear/advice/vibration.shtml.

*Primary Examiner* — David S. Warren
(74) *Attorney, Agent, or Firm* — Courtney M. Dunn; Smith & Hopen, P.A.

(57) ABSTRACT

Disclosed is a method for modifying the frequency response of a wooden article by exciting the article with acoustic energy. Frequency response is the measure of a system's spectrum response at the output due to a signal of varying frequency (but constant amplitude) at its input. The acoustic energy includes at least one excitation frequency, a composite broadband frequency component, or a combination thereof, which is preferably in the audible spectrum (20 to 20,000 Hz). The use of acoustic energy from the remote source provides non-contact excitation of the wooden article. In one embodiment, the acoustic energy is at least one sound wave which comprises at least one resonant frequency of the wooden article, at least one acoustic mode of the wooden article, at least one discrete frequency, a broadband frequency component, or any combination thereof.

10 Claims, 10 Drawing Sheets

U.S. PATENT DOCUMENTS 5,023,824 A 6/1991 Chadima et al.
5,031,501 A 7/1991 Ashworth
5,067,573 A 11/1991 Uchida
5,168,145 A 12/1992 Tackett et al.
5,198,651 A 3/1993 Barkan et al.
5,410,141 A 4/1995 Koenck et al.
5,416,283 A 5/1995 Dault
5,422,442 A 6/1995 Gouda et al.
5,468,952 A 11/1995 Alexander et al.
5,475,214 A 12/1995 DeFranco et al.
5,488,575 A 1/1996 Danielson et al.
5,537,908 A * 7/1996 Rabe et al. ..... 84/454
5,600,081 A * 2/1997 Simjian ..... 84/453
5,600,121 A 2/1997 Kahn et al.
5,612,720 A 3/1997 Ito et al.
5,657,201 A 8/1997 Kochis
5,703,626 A 12/1997 Itoh et al.
5,736,726 A 4/1998 VanHorn et al.
5,744,791 A 4/1998 Isaac et al.
5,763,864 A 6/1998 O'Hagan et al.
5,801,371 A 9/1998 Kahn et al.
5,911,396 A * 6/1999 Bireley ..... 248/340
5,969,328 A 10/1999 Kunert
6,036,098 A 3/2000 Goldman et al.
6,040,510 A 3/2000 Yaun
6,065,679 A 5/2000 Levie et al.
6,068,307 A 5/2000 Murphy
6,109,528 A 8/2000 Kunert et al.
6,112,993 A 9/2000 Svetal et al.
6,170,748 B1 1/2001 Hash et al.
6,179,135 B1 * 1/2001 Simpson ..... 211/85.6
6,262,354 B1 7/2001 Solomon
6,394,355 B1 5/2002 Schlieffers et al.
6,410,865 B1 6/2002 Liu et al.
6,415,982 B2 7/2002 Bridgelall et al.
6,495,784 B2 12/2002 Yoon et al.
6,497,368 B1 12/2002 Friend et al.
D473,658 S * 4/2003 Adams ..... D25/33
6,605,765 B1 8/2003 Johnson
6,708,883 B2 3/2004 Krichever
6,722,569 B2 4/2004 Ehrhart et al.
6,822,853 B2 11/2004 Wulff et al.
7,064,745 B2 6/2006 Kim
7,069,061 B2 6/2006 Gammon et al.
7,195,169 B2 3/2007 Bhatia et al.
7,227,068 B1 * 6/2007 Van Doren ..... 84/297 R
7,259,310 B2 * 8/2007 Wilfer ..... 84/327
2001/0042681 A1 11/2001 Yoon et al.
2004/0017924 A1 1/2004 Kuratani et al.
2004/0060417 A1 4/2004 Janes et al.
2004/0252851 A1 12/2004 Braun
2004/0255753 A1 * 12/2004 Wilfer ..... 84/327
2005/0000348 A1 1/2005 Workman
2005/0011951 A1 1/2005 Chang et al.
2005/0155481 A1 7/2005 Yu
2005/0252363 A1 11/2005 Rockett
2006/0072768 A1 4/2006 Schwartz et al.
2006/0117938 A1 6/2006 Gillette
2007/0175320 A1 * 8/2007 Hall et al. ..... 84/723
2008/0190260 A1 * 8/2008 Lye ..... 84/173
2008/0289483 A1 * 11/2008 Hall et al. ..... 84/723
2009/0229445 A1 * 9/2009 Courtright et al. ..... 84/453
2009/0293707 A1 * 12/2009 Suhr ..... 84/723

* cited by examiner

FIG. 3A $$P_{FF}(f) = \Sigma\,(F(f)\,F(f)^*)\,/\,n\ ,\ P_{AA}(f) = \Sigma\,(A(f)\,A(f)^*)\,/\,n\ ,\ P_{AF}(f) = \Sigma\,(F(f)\,A(f)^*)\,/\,n \quad (1)$$

where * indicates complex conjugate.

FIG. 3B $$FR(f) = \frac{P_{AF}(f)}{P_{FF}(f)} \quad (2)$$

FIG. 3C $$\gamma^2(f) = \frac{P_{AF}(f)\,P_{AF}(f)^*}{P_{FF}(f)\,P_{AA}(f)} \quad (3)$$

Initial frequency response measured versus the final response, left position, before (blue) and after (red) treatment for one week (Example III).

GUITAR-1

Initial frequency response measured versus the final response, center position, before (blue) and after (red) treatment for one week (Example III).

GUITAR-1

Initial frequency response measured versus the final response, left position, before (blue) and after (red) treatment for one week (Example III).

Initial frequency response measured versus the final response, center position, before (blue) and after (red) treatment for one week (Example III).

METHOD OF MODIFYING THE FREQUENCY RESPONSE OF A WOODEN ARTICLE

CROSS REFERENCE TO RELATED APPLICATIONS

This application is a continuation-in-part to copending U.S. patent application Ser. No. 11/668,031, filed Jan. 29, 2007, which application claims priority to U.S. Provisional Application 60/763,021 filed on Jan. 27, 2006, which is incorporated herein by reference.

BACKGROUND OF THE INVENTION

The acoustic properties of wood are well documented. The selection of wood as a construction material, particularly for acoustic applications such as instruments and concert halls, is important because the sound is produced by the vibrations of the material itself. The characteristics which determine the acoustic performance of a material are density, Young's modulus and loss coefficient (see Wegst, U. 2006. Wood for sound. *American Journal of Botany* 93: 1439-1448).

Pitch, loudness and timbre represent the three auditory attributes of sound. Pitch represents the perceived fundamental frequency of a sound, which can be precisely determined through physical measurement. The intensity of a sound is a function (the square of the amplitude) of the vibration of the originating source. In addition to a pitch associated with a sound, an acoustic body such as a musical instrument also has a pitch which is audible when vibrated. The acoustics of a given body depend on shape as well as the material from which the body is made (Wegst).

It is known that the sound quality of stringed instruments is enhanced with age, specifically from actual playing-time (or use). The wood used to construct the instruments provides a more pleasing result as the instrument is played. It is for this reason that such a high value is placed on vintage instruments.

The vibration associated with use of the instrument causes subtle changes in the pliability of the wood. Vibration alters the natural resins within the wood. Moreover, finishes such as lacquer, commonly applied to wooden stringed instruments, are affected by vibration and result in the loss of plasticizers. These changes usually take many years.

Others have sought to shorten the time needed to gain the desired effects of aging. For example, U.S. Pat. No. 2,911,872 describes a motor powered apparatus which mechanically bows the strings of a violin. The system can be set up such that the strings can be played at any selected position and bowed in succession. U.S. Pat. No. 5,031,501 describes a small shaker board device which is attached to the sound board of a stringed instrument. The shaker is then driven by a musical signal to simulate what the sound board experiences as it is being played. These approaches both provide automatic means to simulate playing the instrument, thus allowing the instrument to be aged without the expenditure of time or effort by a real musician. However, both approaches take a prolonged period of time to age a new instrument because they basically simulate playing the instrument; aging occurs in real time.

U.S. Pat. No. 5,537,908 developed a process for wooden stringed instruments that utilizes broadband vibration from a large electromagnetic shaker and controller. The instrument is attached to a specially designed shaker fixture and then subjected to broadband vibration excitation. The broadband input provides excitation over the frequency range of 20 to 2,000 Hz, providing accelerated aging compared to single tone inputs from earlier methods. Experienced musicians attested to hearing improvement in sound producing ability after application of this method. In addition, simple vibration measurements showed an increase in instrument response. The process, however, requires direct contact or coupling with a large electromagnetic shaker which can and result in damage to the instruments processed. In addition, the upper frequency limit of such shakers is about 2,000 Hz, whereas the full audible spectrum is from 20 up to 20,000 Hz.

In addition to its use in the construction of instrument, wood is an important component in the acoustic makeup of structures. Concert halls in particular are meticulously constructed to maximize acoustic effect. To this end, great care goes into the selection and placement of construction materials. Two important factors, with regard to room acoustics, are reverberation time as well as the level of reverberant sound. Wood is often used to maximize acoustic effect through the placement of wooden panels which act as reflectors and resonators, and the use of wood flooring and stage construction are necessary for the optimization of the sound field and reverberation time (Wegst, 2006).

An acoustic system such as a musical instrument or a concert hall, possesses acoustic resonances. Resonance refers to the tendency of a system to oscillate at maximum amplitude at certain frequencies, known as the system's resonance frequencies (or resonant frequencies). At these frequencies, even small periodic driving forces produce large amplitude vibrations, because the system stores vibrational energy.

Acoustic resonance is the tendency of the acoustic system to absorb more energy when the frequency of its oscillations matches the system's natural frequency of vibration (its resonance or resonant frequency) than it does at other frequencies. Most objects have more than one resonance frequency, especially at harmonics of the strongest resonance. An acoustic system will easily vibrate at the strongest frequencies, and vibrate to a lesser degree at other frequencies. Materials, such as wood, possess the ability to react to its particular resonance frequency even when it is subjected to a complex excitation, such as an impulse or a wideband noise excitation. The net effect is a filtering-out of all frequencies other than its resonance.

SUMMARY OF INVENTION

In one embodiment, the invention includes a method of modifying the frequency response of a wooden article by applying acoustical energy from an acoustical energy source to the wooden article. The article can be any wooden article for use in an acoustical system such as musical instruments, unfinished wood, finished wood, wood panels and flooring. In one embodiment, the article is suspended in an enclosure which allows free vibration and prevents damping from contact with a support surface.

The acoustical energy has a predetermined spectral content consisting of at least one resonant frequency of the wooden article, at least one discrete frequency, a composite broadband frequency component or a combination thereof. In one embodiment, the excitation frequency is substantially maintained for a predetermined time (i.e., from several hours to several weeks). Results of the treatment can be modified by altering the treatment time and/or intensity. In an illustrative embodiment, the article is treated between about 90 and 140 dB. The acoustic energy can be applied perpendicularly to the longitudinal axis of the article or in parallel.

BRIEF DESCRIPTION OF THE DRAWINGS

For a fuller understanding of the nature and objects of the invention, reference should be made to the following detailed description, taken in connection with the accompanying drawings, in which:

FIG. 3A is the formula for calculating the average power and cross spectra.

FIG. 3B is the formula for computing frequency response.

FIG. 3C is the formula for calculating coherence $\gamma^2(f)$ as a function of frequency.

DETAILED DESCRIPTION OF THE PREFERRED EMBODIMENT

In the following detailed description of the preferred embodiments, reference is made to the accompanying drawings, which form a part hereof, and within which are shown by way of illustration specific embodiments by which the invention may be practiced. It is to be understood that other embodiments may be utilized and structural changes may be made without departing from the scope of the invention.

The invention includes a method for modifying the frequency response of a wooden article by exciting the article with acoustic energy. Frequency response is the measure of a system's spectrum response at the output due to a signal of varying frequency (but constant amplitude) at its input.

The acoustic energy comprises at least one excitation frequency, which is preferably in the audible spectrum (20 to 20,000 Hz). The use of acoustic energy from a remote source provides non-contact excitation of the wooden article. In one embodiment, the acoustic energy is at least one sound wave which comprises at least one resonant frequency of the wooden article, at least one acoustic mode of the wooden article, at least one discrete frequency, a composite broadband frequency component (including multiple broadband frequencies, white noise and pink noise) or any combination thereof.

The acoustic energy source of one embodiment is an electromechanical transducer, or any device that converts one type of energy to another (such as converting electricity into sound waves). In an illustrative embodiment, the acoustic energy source is a three-way speaker comprising three drivers: large for the bass, midsize for the midrange frequencies, and small for the high frequencies.

Figure 1:
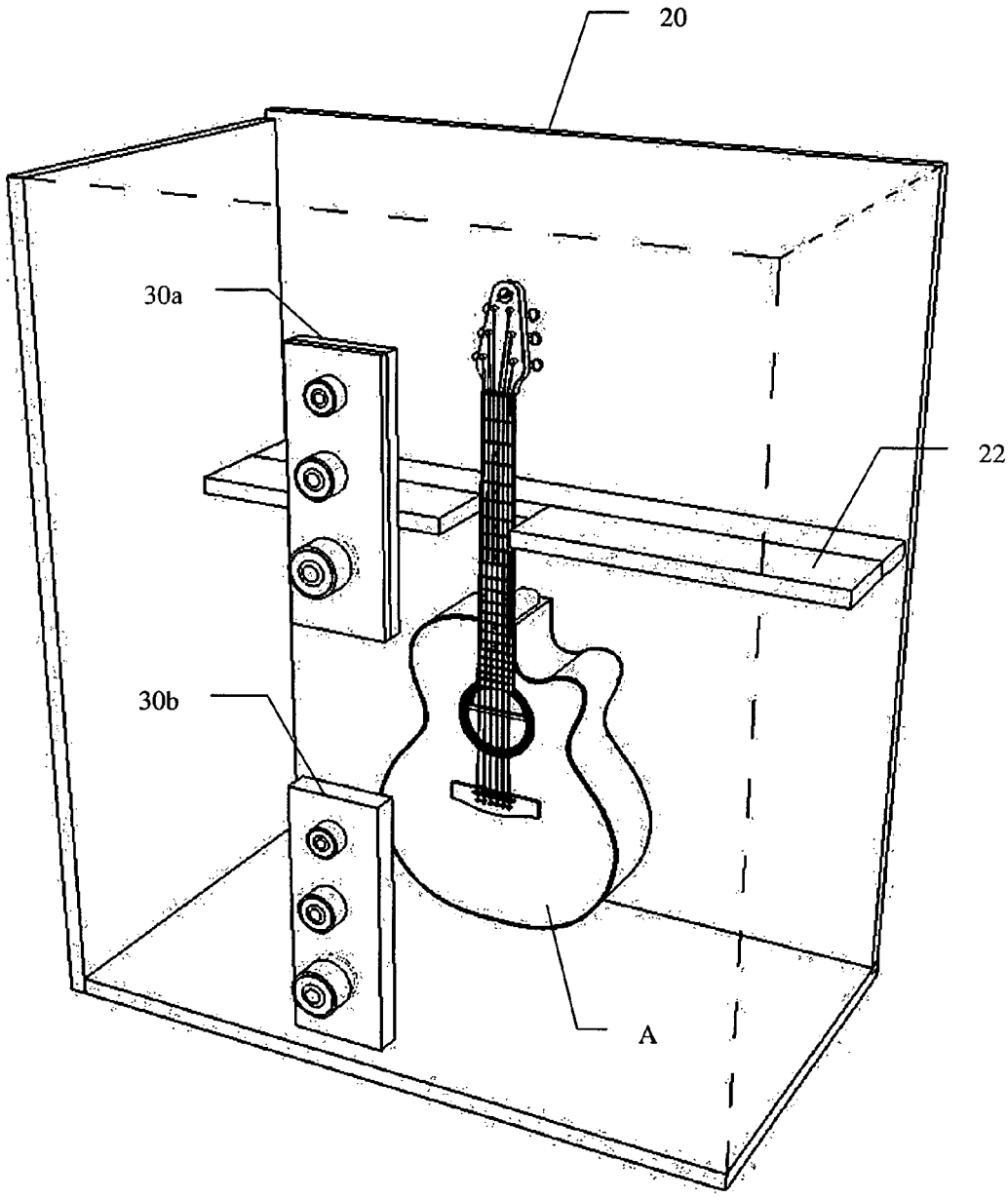
FIG. 1 is a perspective view of an illustrative device for implementing the inventive method.
Figure 2:
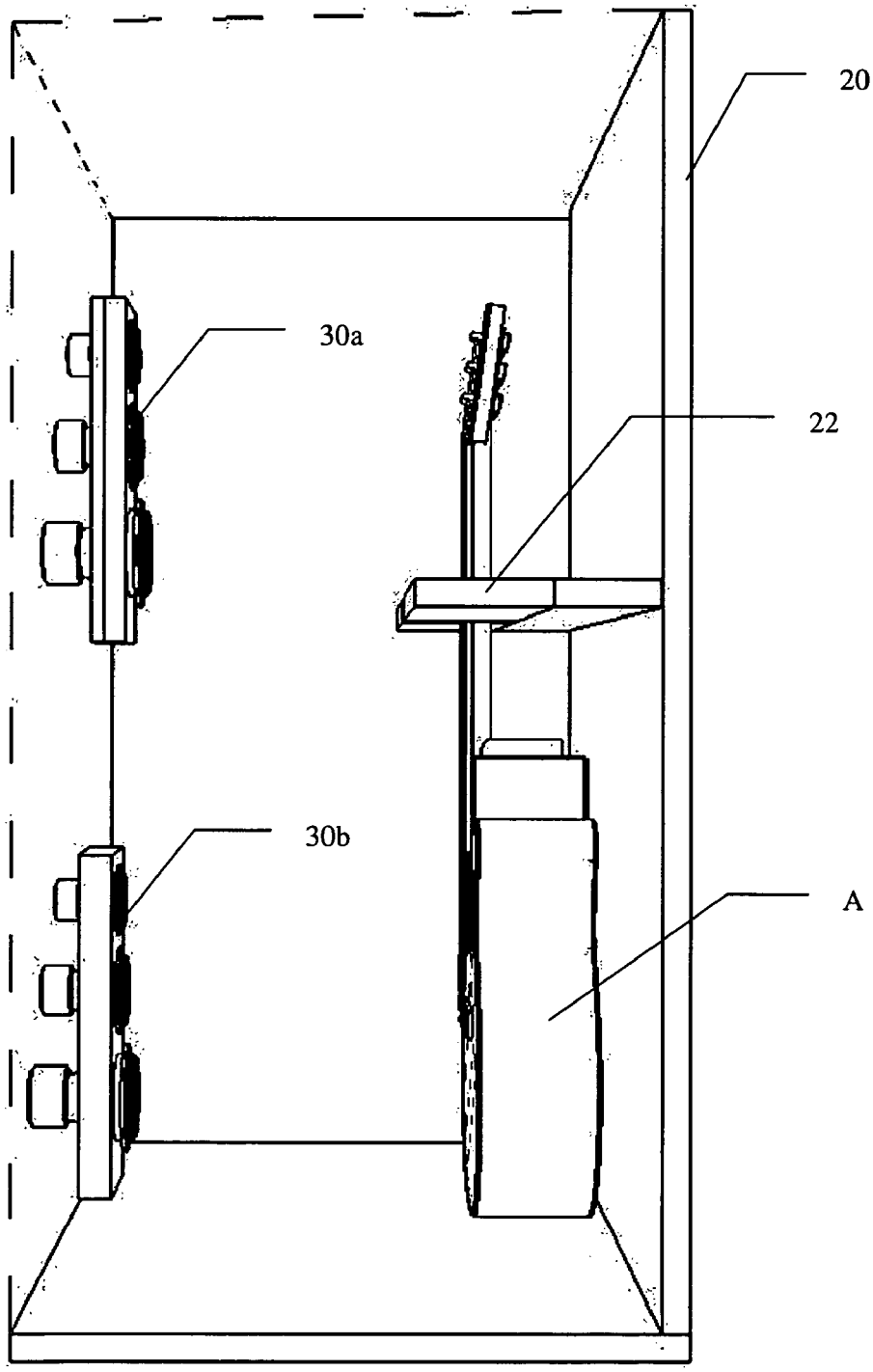
FIG. 2 is a side view of the illustrative device of FIG. 1.

An illustrative device for employing the inventive method is shown in FIGS. 1 and 2. Wooden article A, here a guitar, is suspended in enclosure 20. Suspension of the article prevents damping due to the articles contact with the body. The enclosure can be mobile, resembling a box or case, or can be a room or building specifically adapted for the accelerated aging of multiple instruments or large instruments such as a piano. In FIG. 1, the enclosure (20) is a box (with most of sides omitted for ease of viewing). Wooden article A is suspended in enclosure 20 at the neck by support 22. Padding can be used to isolate instrument A from support 22 and to protect its surface. Enclosure 20 can be constructed from any suitable material, including inexpensive materials such as medium density fiberboard. Acoustic energy source, here speakers 30*a* and 30*b*, are positioned to apply acoustic energy to the surface of article A. In one embodiment, a pair of speakers is utilized with one speaker 30*a* facing the front body of instrument A and the second speaker 30*b* facing the instrument's neck. In an alternate embodiment, speaker 30*a* faces the front body of instrument A and the second speaker 30*b* faces the back or side of the article. The acoustic energy emanating from the acoustic energy source can be amplified through a power amplifier (not shown). In one embodiment, the acoustic energy is applied between about 90 and 140 dB. The acoustic energy source is adapted to run continuously for hours, days or weeks at a time.

Test instruments were assessed before and after receiving an acoustic treatment as described above. Experienced musicians provided subjective input on test instruments and found significant improvement with respect to response, playability, and ease of tuning. In addition, frequency response data computed from swept-sine testing or from impact testing (using a miniature soft tipped impact hammer and a miniature accelerometer) revealed significant improvements in measured response.

Frequency response, FR(f), was determined with the input force F (in units of Newtons, N) to the article as the input and the resulting vibratory acceleration A (in units of g) of the article sound board as the output. It was calculated using a two-channel dynamic signal analyzer. Time trace measurements of the dynamic input and output were obtained, these measurements were windowed, and the fast Fourier transforms of these windowed time traces computed. This was repeated at 4 to 8 times, and the average power and cross spectra are computed as using equation (1) in FIG. 3A. The frequency response was then computed using equation (2) in FIG. 3B.

The magnitude of the response function is presented graphically in FIGS. 4A through 6 as g/N versus frequency. Coherence was also computed to assess the validity of the measurement. Coherence provides a measure of the power in the test instrument vibration that is caused by the power in the input. A coherence of 1 indicates that all of the vibratory acceleration is caused by the input, whereas a coherence of 0 indicates that none of the vibration is caused by the input. The coherence $\gamma^2(f)$ is a function of frequency and is computed equation (3) (FIG. 3C).

Example

Tests with several violins and guitars were performed. The instruments were subjected to the acoustic treatment, as describe above, continuously for several weeks (12 weeks for violins and 8 weeks for guitars) using pink noise (1/f) broadband input. The instruments were assessed both before and after the treatment by experienced musicians and through frequency response measurements performed weekly.

The musicians noticed a vast improvement in the tonal quality (warmer), responsiveness (increased response), and ease of tuning. The improved ease in tuning is of special interest because new instruments (especially student quality string instruments) are very difficult to get and keep in tune.

Figure 4A:
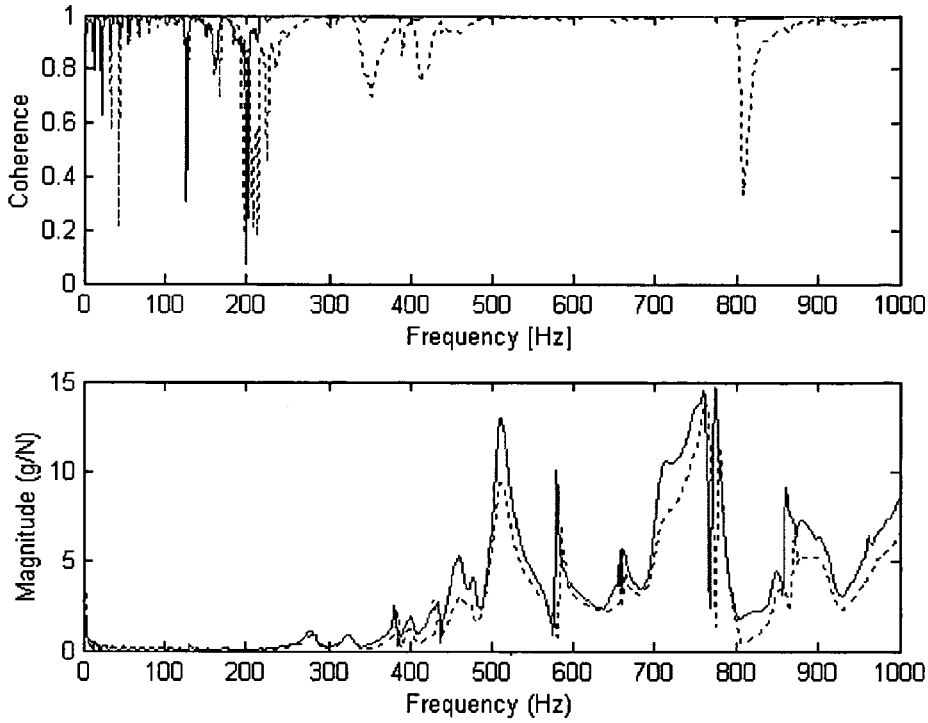
FIG. 4A is a graph showing representative initial and final (i.e., before and after) frequency response data (Example I).
Figure 4B:
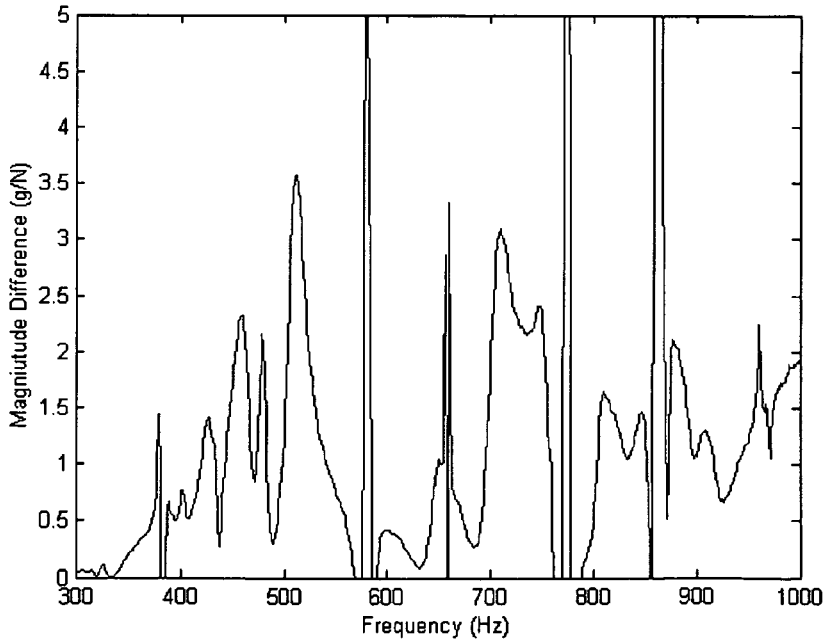
FIG. 4B is a graph showing the difference in magnitude after the aging treatment (Example I).

FIG. 4A shows representative initial and final (i.e., before and after) frequency response data. The coherence shows that most of the response is due to the input over most of the frequency range assessed. The magnitude is notably higher following the aging treatment. This is highlighted in FIG. 4B which shows the difference in magnitude. This data clearly shows that the instrument yields more vibratory response (g) per unit input (N) over most of the frequency range. This is consistent with one of the findings observed independently from experienced musicians.

Example II

Figure 5:
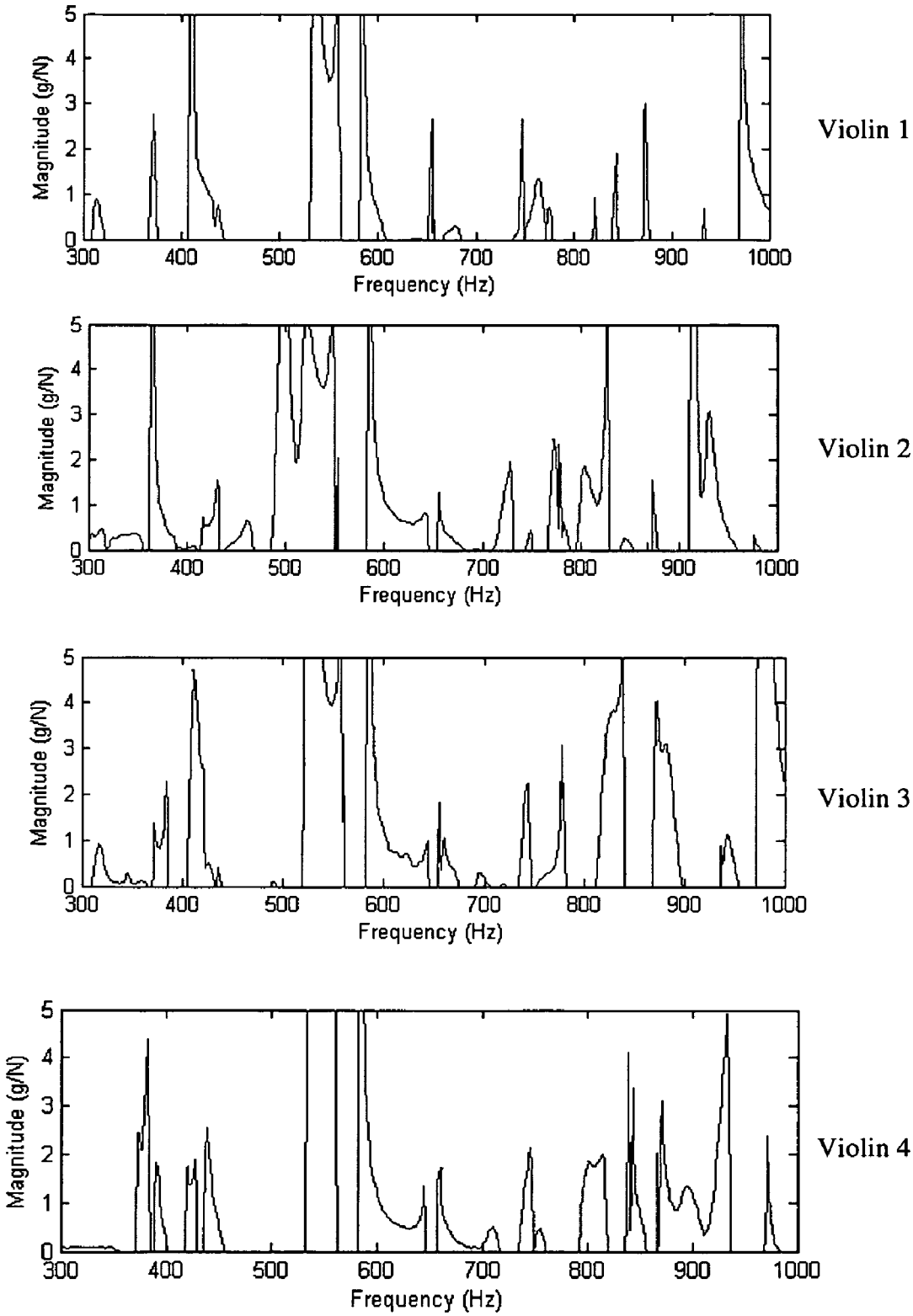
FIG. 5 shows graphs of the initial frequency response measured versus the final response for test violins (Example I).

Additional tests were performed on four violins and three guitars. The repeatability of the process is shown consistently between the ranges of 500-600 Hz and 800-900 Hz for the violins. FIG. 5 shows the magnitude difference or final minus initial response for the violins over the range of 0 to 5 g/N. A positive magnitude change means that the instruments produce more sound, or respond more for the same energy input; a significant aspect of this process. The violins used for testing ranged in quality from very cheap ($150.00) to moderately priced ($1200.00) with the building quality commensurate with the price paid.

Figure 6:
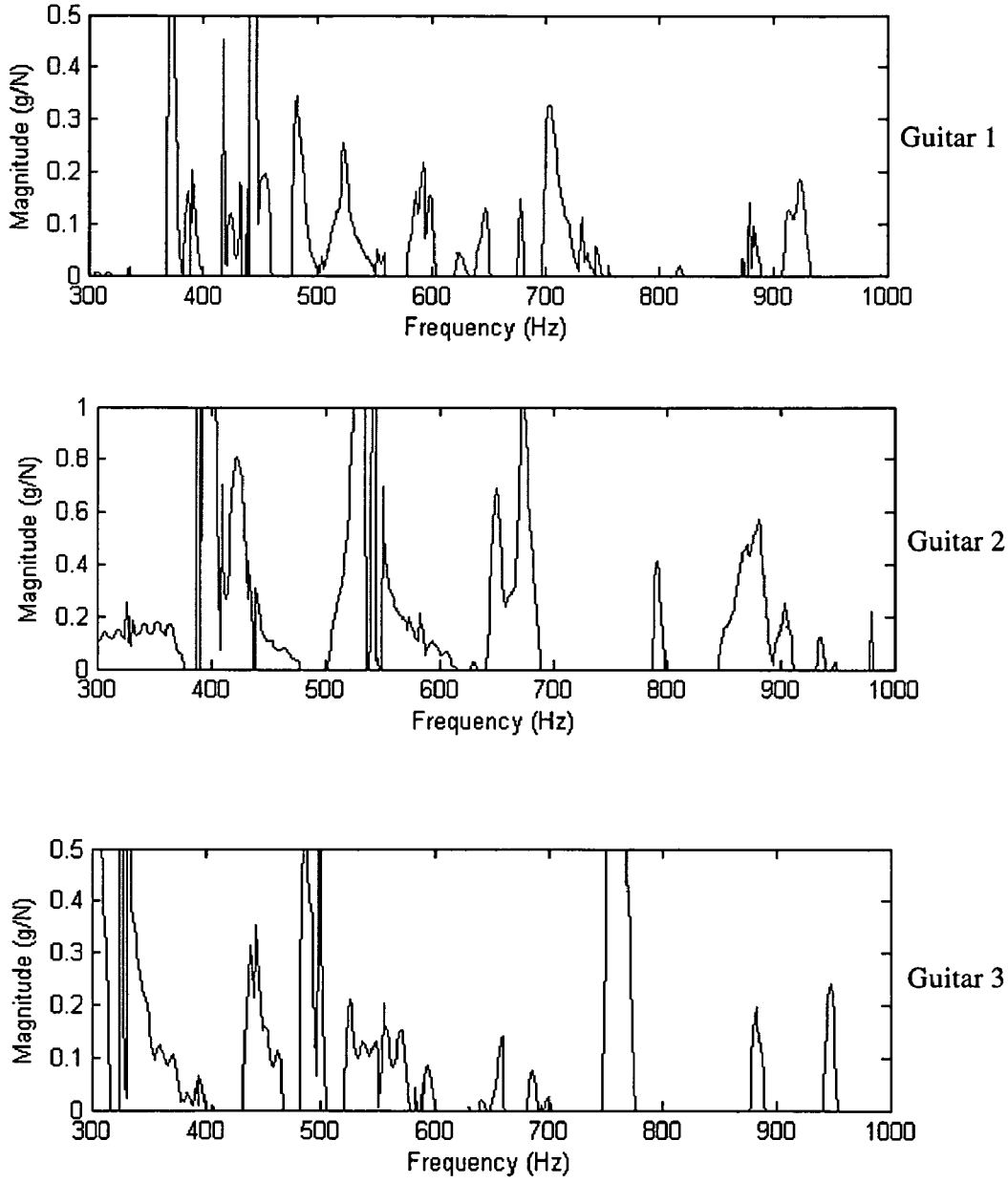
FIG. 6 shows graphs of the initial frequency response measured versus the final response for guitars (Example II).
Figure 7:
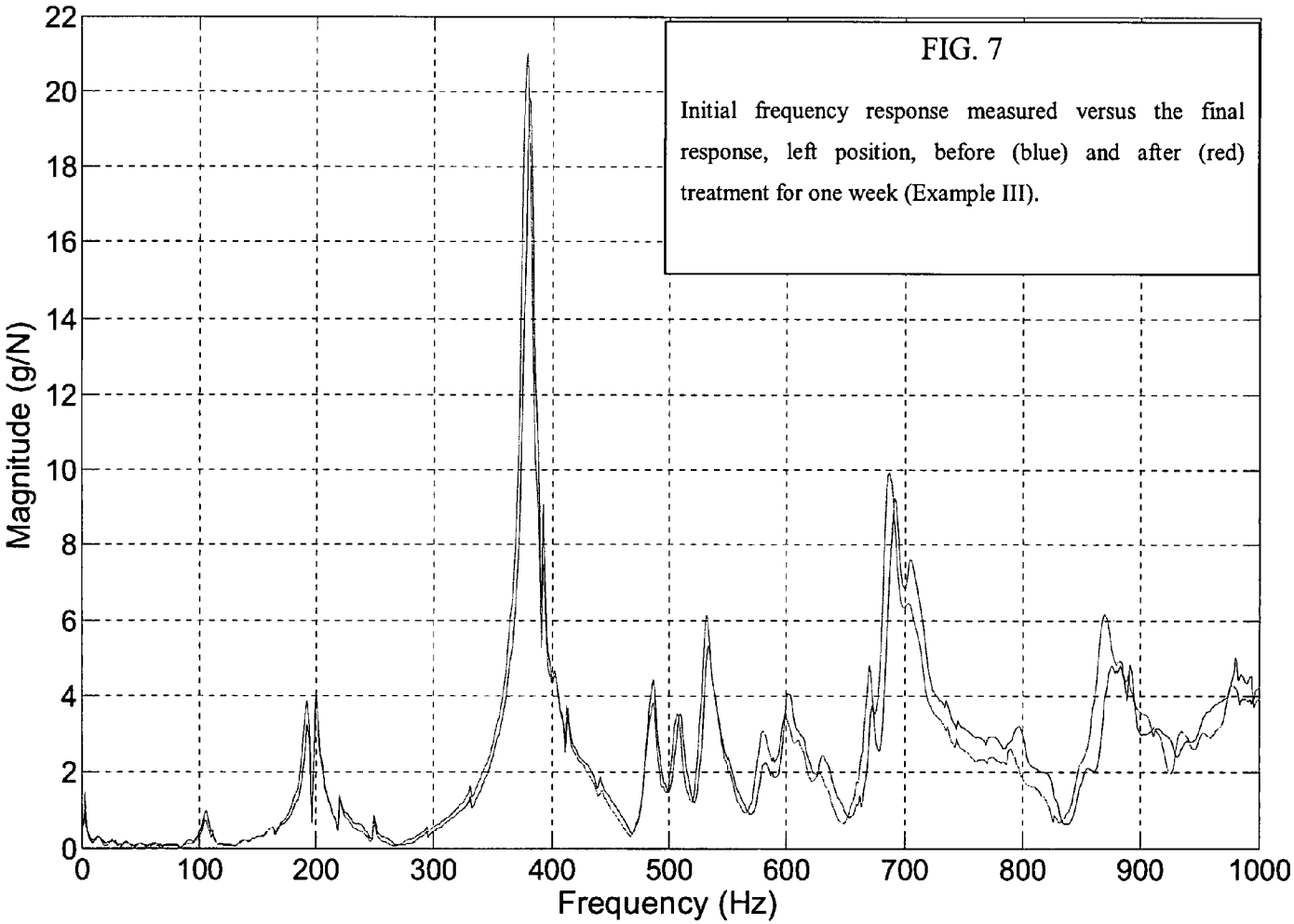
FIG. 7 shows graphs of the initial frequency response measured versus the final response for the first guitar, left position, before and after treatment for one week (Example III).
Figure 8:
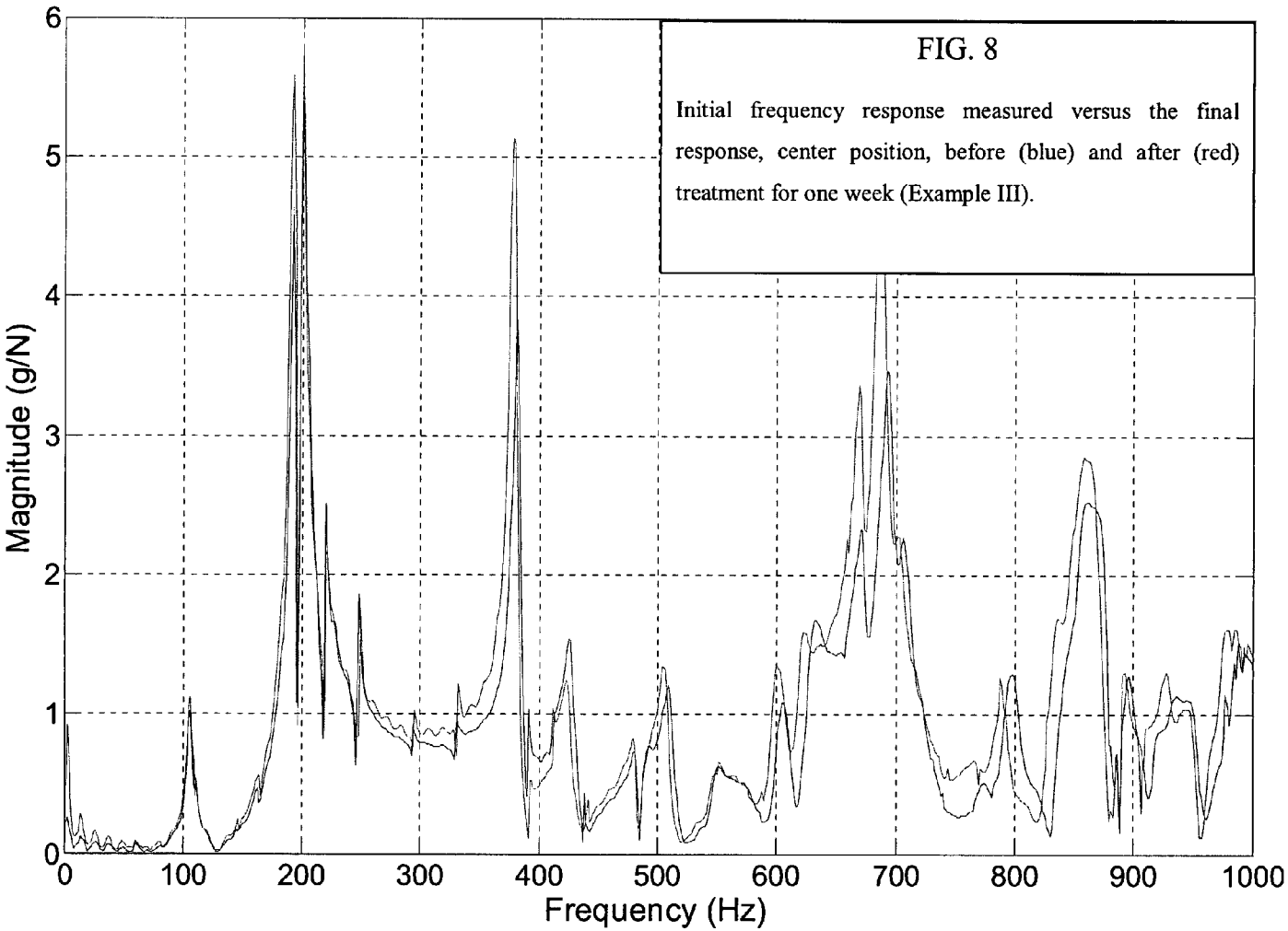
FIG. 8 shows graphs of the initial frequency response measured versus the final response for the first guitar, center position, before and after treatment for one week (Example III).
Figure 9:
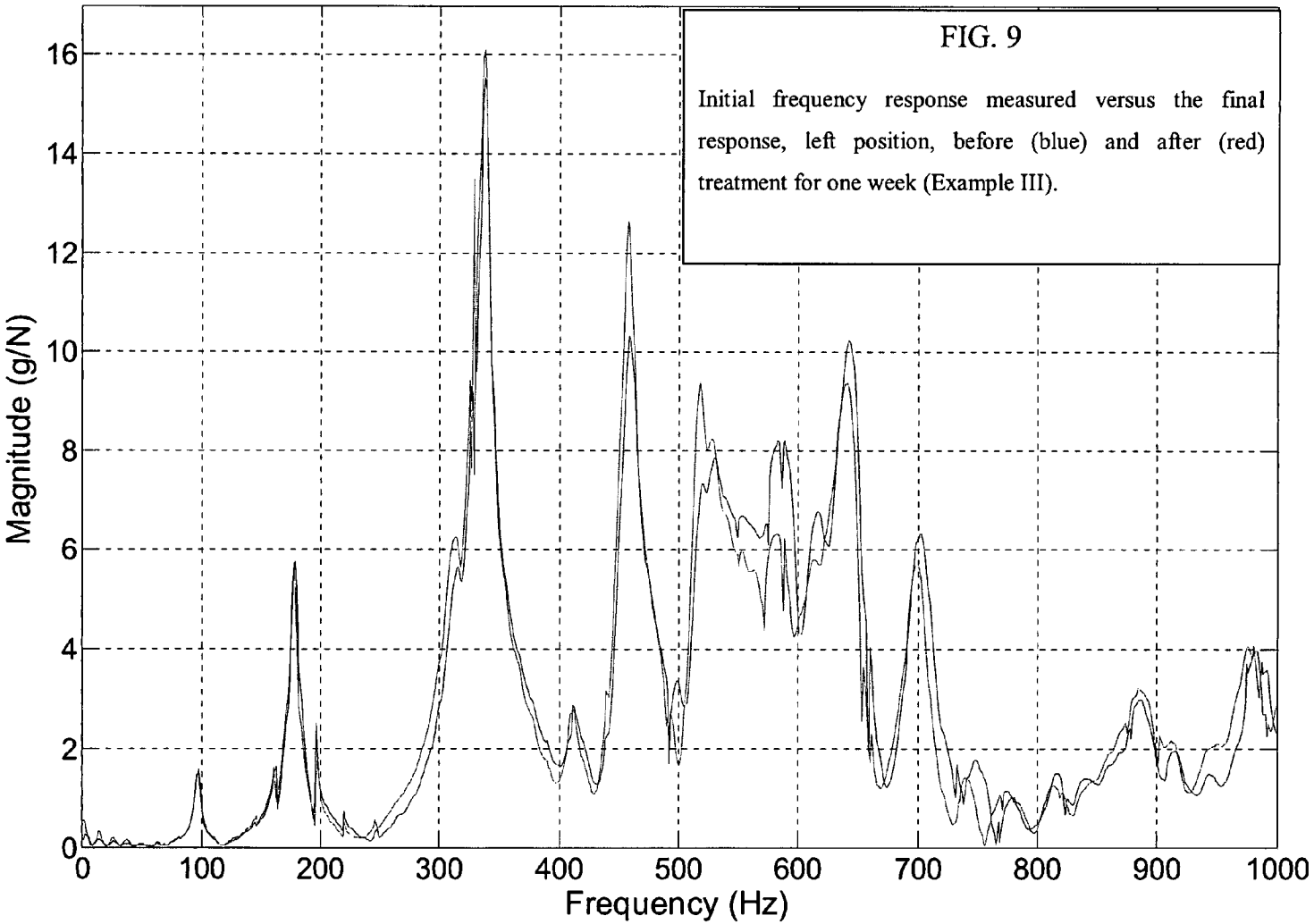
FIG. 9 shows graphs of the initial frequency response measured versus the final response for the second guitar, left position, before and after treatment for one week (Example III).
Figure 10:
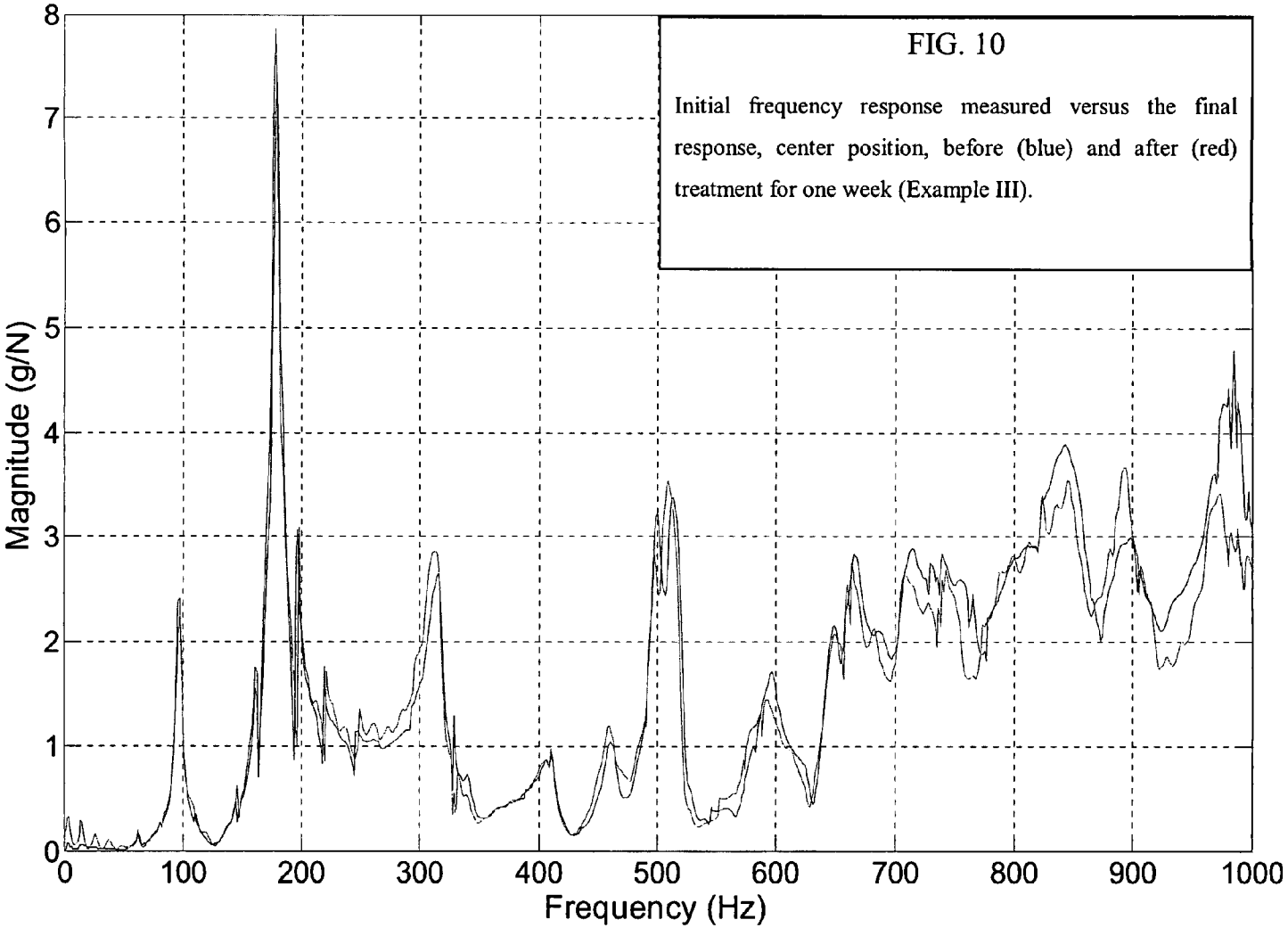
FIG. 10 shows graphs of the initial frequency response measured versus the final response for the second guitar, center position, before and after treatment for one week (Example III).

The repeatability of the process is consistent between the ranges of 700-900 Hz for the guitars (FIG. 6). The change in magnitude in response is in shown in FIG. 6 over the range of 0 to 0.5 g/N. Even though the magnitude change is significantly less than the results found for the violin, this is still significant.

Example III

Two additional guitars were treated for a period of one week (168 hours) with the method as described above. The guitars were suspended at the neck as shown in FIG. 1. Padding was used to protect their surfaces. The acoustic energy was non-contact, broadband audio at a sound level of 110 dB.

The vibratory response of the guitars was assessed before and after the treatment using impact testing. For this test, the guitars were suspended on elastic bands under the nut and at the end pin. The impact was applied on the bass side of the bridge with a PCB model 086D80 hammer with a vinyl tip and a sensitivity of 59.5 N/V, which provides fairly uniform excitation up to 1,000 Hz. A spring and a positioning guide were used to provide repeatable hammer hits.

The vibration of the guitars was measured with a PCB model 309A accelerometer placed at two different positions: (a) on the bass or left side of the bridge (one inch from the bridge), and (b) at the center (one inch from the bridge). The sensitivity of the accelerometer was 200 g/V. It was attached with bees wax, which is easily removed and does not damage the guitar finish.

The vibratory response, shown in FIGS. 7 through 10, is presented as the magnitude of the frequency response with units of acceleration output per unit force input, i.e., g/N. This is computed from an average of four impact force and accelerometer measurements using a spectrum analyzer. Measurements were taken every 24 hours to monitor change and each test was done twice to check repeatability.

The data shows that one week of treatment causes an increase in amplitude in several of the vibratory modes. Physically, this means more response (measured acceleration) for the same input (measured impact force). In addition, the treatment causes a decrease in frequency of several of the resonant frequencies. This indicates increased flexibility (or decreased stiffness). Treatment at higher sound levels will potentially induce larger changes and/or reduce treatment time.

It will be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall there between. Now that the invention has been described,

What is claimed is:

1. A method of modifying the frequency response of a wooden article, comprising the steps of:

placing the wooden article in an enclosure having at least one acoustical energy source;

suspending the wooden article from a support structure located in the enclosure;

providing a broadband electrical signal having a range from 20 to 20,000 Hz to the acoustical energy source to create acoustical energy having at least one resonant frequency of the wooden article, at least one acoustic mode of the wooden article, and at least one discrete frequency; and applying the acoustical energy from the at least one acoustical energy source to the wooden article.

2. The method of claim 1, wherein the frequency content of the acoustical energy is substantially maintained.

3. The method of claim 1, wherein the acoustical energy is applied to the wooden article for a predetermined time.

4. The method of claim 1, wherein the acoustical energy has a sound pressure level greater than about 60 dB.

5. The method of claim 1, wherein the acoustical energy has a sound pressure less than about 150 dB.

6. The method of claim 1, wherein the acoustical energy is applied to the article from several hours up to several weeks.

7. The method of claim 1, wherein the article is selected from the group consisting of musical instruments, unfinished wood, finished wood, wood panels and flooring.

8. The method of claim 1, wherein the acoustic energy source is substantially perpendicular to the surface of the article.

9. The method of claim 1, wherein the acoustic energy source is substantially parallel to the surface of the article.

10. The method of claim 1, wherein the acoustical energy has a sound pressure level greater than about 110 dB.

* * * * *